US007206529B2

(12) United States Patent
Nakazato et al.

(10) Patent No.: US 7,206,529 B2
(45) Date of Patent: Apr. 17, 2007

(54) IMAGE FORMING APPARATUS AND CONTROL METHOD FOR THE SAME

(75) Inventors: Hiroshi Nakazato, Nagano-ken (JP); Ken Ikuma, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 89 days.

(21) Appl. No.: 10/965,667

(22) Filed: Oct. 14, 2004

(65) Prior Publication Data

US 2005/0105928 A1 May 19, 2005

(30) Foreign Application Priority Data

Oct. 17, 2003 (JP) ..... 2003-358431

(51) Int. Cl.
*G03G 15/00* (2006.01)

(52) U.S. Cl. ..... 399/49

(58) Field of Classification Search ..... 399/49
See application file for complete search history.

(56) References Cited

U.S. PATENT DOCUMENTS 5,740,495 A * 4/1998 Maher et al. ..... 399/49 X
5,950,036 A * 9/1999 Konishi ..... 399/8
6,429,886 B2 * 8/2002 Ohki ..... 399/38 X

FOREIGN PATENT DOCUMENTS

| | | |
|---|---|---|
| EP | 1 298 500 | 4/2003 |
| EP | 1 388 764 | 2/2004 |
| JP | 2001-075318 | 3/2001 |
| JP | 2002-189391 | 7/2002 |

* cited by examiner

*Primary Examiner*—David M. Gray
*Assistant Examiner*—Erika J. Villaluna
(74) *Attorney, Agent, or Firm*—Hogan & Hartson LLP

(57) ABSTRACT

As a user turns on the power, patch processing (Step S104) is executed and image forming conditions are accordingly adjusted. However, when a setting entry for prohibiting the patch processing has been made at the time of power-on (Step S101, Step S103), after setting the image forming conditions to predetermined default conditions without performing the patch processing (Step S108), execution of an image forming operation is permitted (Step S107). The setting entry in this context is pressing of a particular switch by the user at the time of power-on.

4 Claims, 7 Drawing Sheets

IMAGE FORMING APPARATUS AND CONTROL METHOD FOR THE SAME

CROSS REFERENCE TO RELATED APPLICATION

The disclosure of Japanese Patent Application No. 2003-358431 filed Oct. 17, 2003 including specification, drawings and claims is incorporated herein by reference in its entirety.

BACKGROUND OF THE INVENTION

1. Field of the Invention

The present invention relates to an image forming apparatus which adjusts image forming conditions based on a detected density of a patch image, and a control method for such an image forming apparatus.

2. Description of the Related Art

An image forming apparatus such as a printer, a copier machine and a facsimile machine utilizing electrophotographic technology, when needed, forms a small test image (patch image) having a predetermined image pattern, detects the image density of this image with a density sensor, and adjusts operation conditions of the respective portions of the apparatus (image forming conditions) in accordance with the result of the detection, so that a desired image quality is achieved stably.

For instance, in the case of the image forming apparatus described in Japanese Patent Application Laid-Open Gazette No. 2001-75318, warming up of the apparatus is executed immediately after the apparatus has been turned on or immediately after the apparatus has been released from a sleep mode. As this completes, density adjusting processing is carried out. During the density adjusting processing, optimal values of a charging bias and a developing bias, which serve as density control factors which influence the qualities of images, are calculated based on a detected density of a solid or halftone image formed as a patch image. With the charging bias and the developing bias set respectively to thus calculated optimal values, optimal image forming conditions are attained. As an image forming operation is executed under the image forming conditions optimized in this manner, an image is formed in a favorable and stable image quality.

Among image forming apparatuses of this type is such an image forming apparatus which outputs, when necessary, a status sheet for the purpose of notifying a user, an operator or someone who otherwise uses the apparatus of the state of the apparatus. The status sheet describes operation parameters for the respective portions of the apparatus, the result of self-diagnosis and the like, When an operator so wishes, it is desirable that these apparatuses will skip the density adjusting processing. These are when the first print time needs be shortened or when a reduction of the amount of toner demanded by the density adjusting processing is desired, for instance. In the event that an image consisting only of letters, characters, lines and the like or a monochrome image is to be formed, precise density adjusting processing is not always necessary. Besides, there may be an instance that a status sheet mentioned above is wanted for the purpose of maintenance of an apparatus. However, the conventional image forming apparatus described above does not meet these demands.

SUMMARY OF THE INVENTION

An object of the present invention is to provide a control technique which makes it possible to flexibly respond to an operator's demand when applied to an image forming apparatus which adjusts an image forming condition based on a detected density of a patch image and a control method for such an image forming apparatus.

To achieve this object, in an image forming apparatus which executes control processing which is for adjustment of image forming conditions, which are to be used during execution of an image forming operation by an image forming section, to predetermined optimal conditions based on a detected density of a patch image formed by the image forming section and in a control method for such an image forming apparatus, when a setting section is operated in a setting operation which prohibits the control processing, the image forming section is permitted execution of the image forming operation while skipping the control processing, according to the present invention.

In other aspect of the present invention, to achieve the object above, in an image forming apparatus which executes control processing which is for adjustment of image forming conditions, which are to be used during execution of an image forming operation by an image forming section, to predetermined optimal conditions based on a detected density of a patch image formed by an image forming section and in a control method for such an image forming apparatus, a setting state of a setting section is judged in accordance with a predetermined operation and the control processing is executed when the setting state is not in a prohibition state which is for the prohibition of the control processing, and when the setting state is in the prohibition state, the image forming section is permitted execution of the image forming operation while skipping the control processing.

In these inventions, the image forming operation is executed normally under the image forming conditions which have been adjusted to the optimal conditions as a result of the control processing. Hence, a user can stably obtain images in a constant image quality. However, when the user operates the setting section in the setting operation so as to prohibit execution of the control processing, execution of the image forming operation is permitted while skipping the control processing. These inventions thus make it possible to flexibly respond to various demands from users.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

DETAILED DESCRIPTION OF THE PREFERRED EMBODIMENTS

Figure 1:
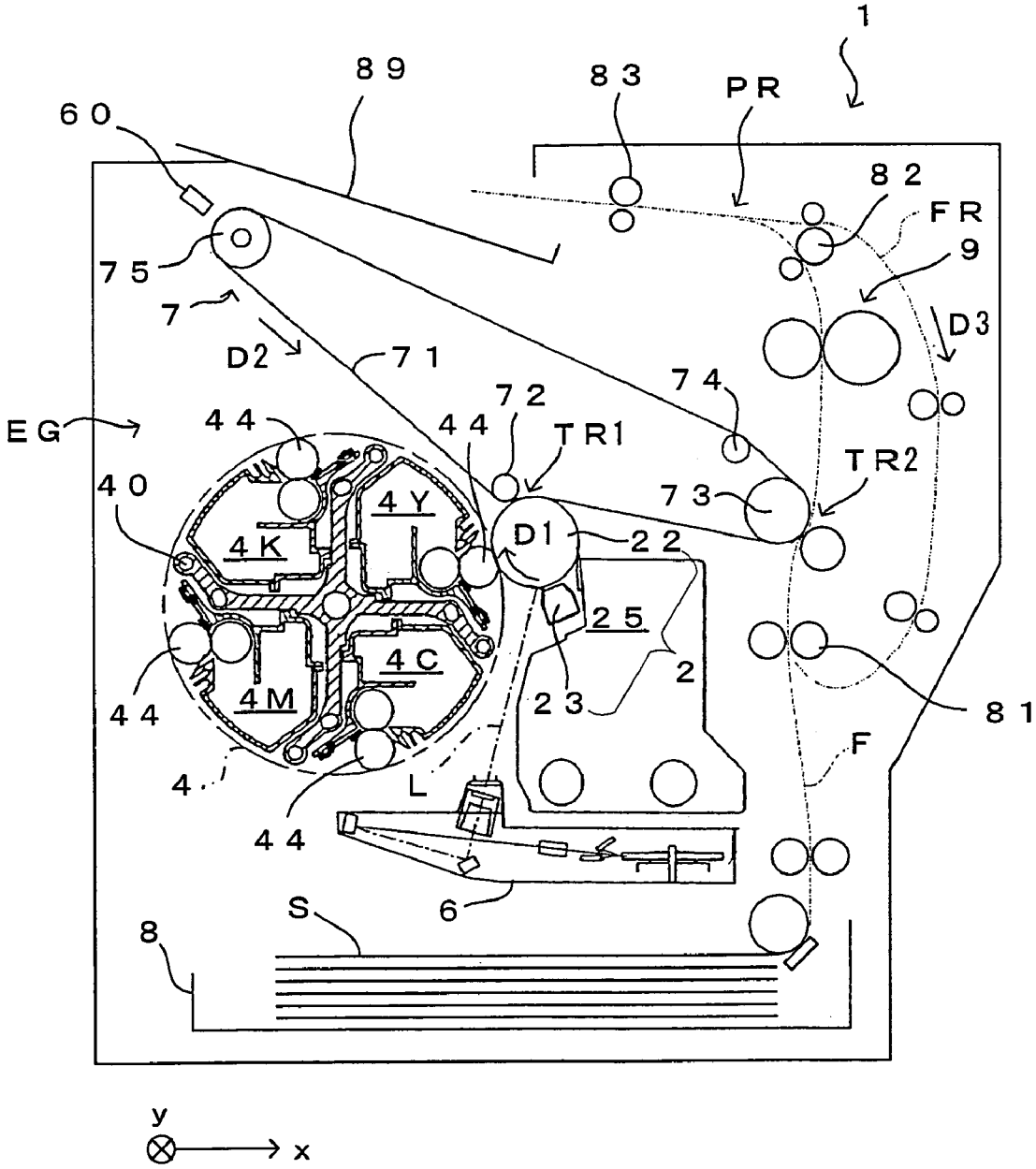
FIG. 1 is a diagram showing a preferred embodiment of an image forming apparatus according to the present invention.
Figure 2:
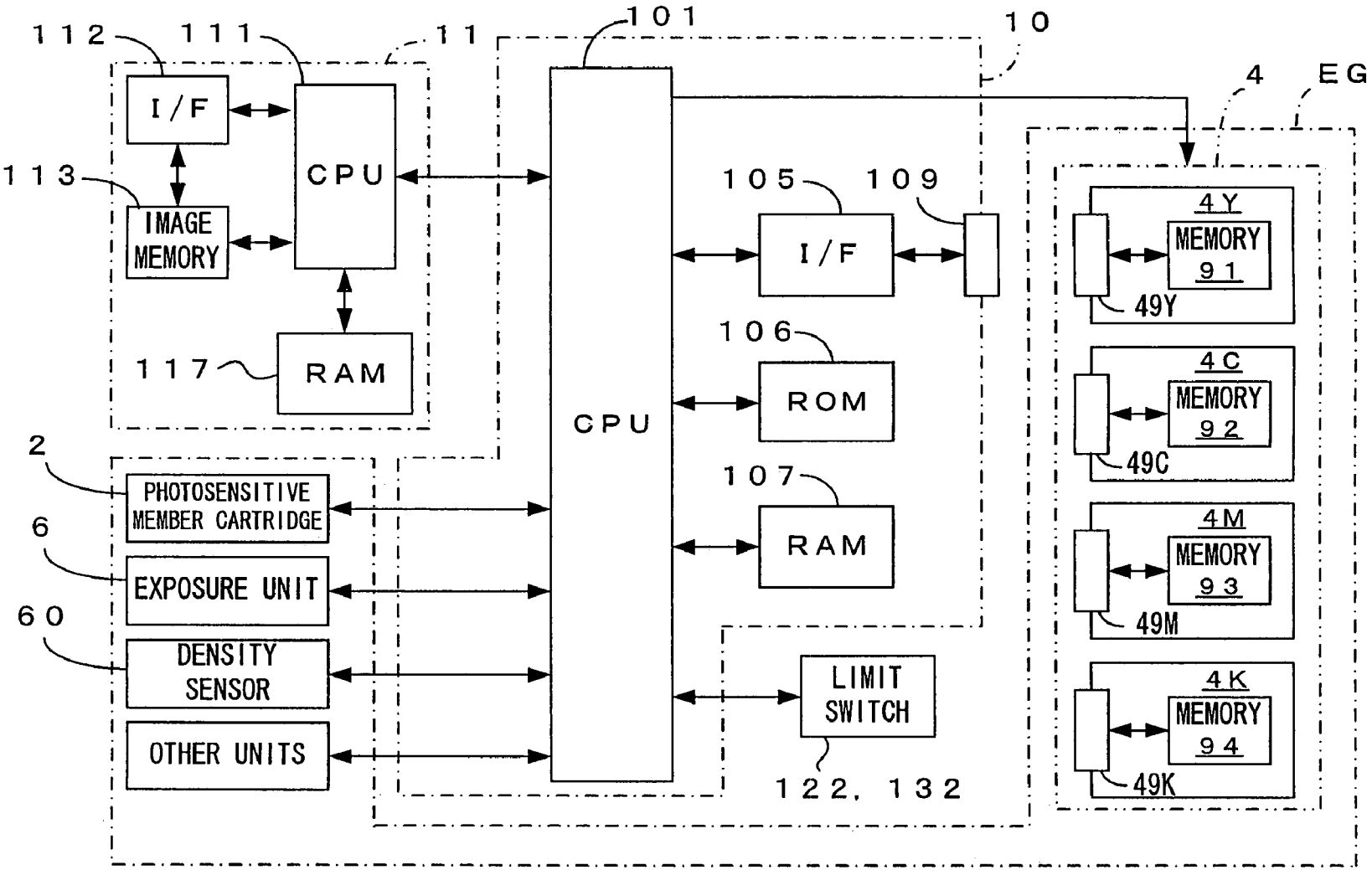
FIG. 2 is a block diagram which shows an electric structure of the apparatus of FIG. 1.

FIG. 1 is a diagram showing a preferred embodiment of an image forming apparatus according to the present invention. FIG. 2 is a block diagram which shows an electric structure of the apparatus of FIG. 1. This apparatus is an image forming apparatus for forming a full color image by superimposing images of toners of four colors: yellow (Y), cyan (C), magenta (M) and black (K) and forming a monochromatic image only using the black (K) toner. In this image forming apparatus, when a print command signal including an image signal is given from an external apparatus such as a host computer to a main controller 11, an engine controller 10 controls individual parts of an engine section EG for executing a specified image forming operation in accordance with a command from the main controller 11, whereby an image corresponding to the image signal is formed on a sheet S.

In this engine section EG, a photosensitive member 22 is rotatably provided in a direction of arrow D1 of FIG. 1. Further, a charger unit 23, a rotary developing unit 4 and a cleaning section 25 are arranged around the photosensitive member 22 along its rotating direction D1. A specified charging bias is applied to the charger unit 23 to uniformly charge the outer circumferential surface of the photosensitive member 22 at a specified surface potential. The cleaning section 25 removes the toner residual on the outer surface of the photosensitive member 22 after a primary transfer and collects it in a waste toner tank provided therein. The photosensitive member 22, the charger unit 23 and the cleaning section 25 are incorporated into a photosensitive-member cartridge 2, which is detachably mountable into the apparatus main body 1 as a single unit.

A light beam L is emitted from an exposure unit 6 toward the outer circumferential surface of the photosensitive member 22 charged by the charger unit 23. This exposure unit 6 exposes the photosensitive member 22 by the light beam L in accordance with the image signal given from the external apparatus to form an electrostatic latent image corresponding to the image signal.

The thus formed electrostatic latent image is developed into a toner image by the rotary developing unit 4. Specifically, the developing unit 4 includes: a supporting frame 40 rotatably provided about a rotary shaft; a developer for yellow 4Y; a developer for cyan 4C; a developer for magenta 4M; a developer for black 4K; and a rotary driving device (not shown). The four developing units 4Y, 4C, 4M and 4K contain the toners of the respective colors and are constructed as cartridges detachably mountable into the supporting frame 40. This developing unit 4 is controlled by the CPU 160. The developing unit 4 is rotated in accordance with a control command from the CPU 101. When the developers 4Y, 4C, 4M, 4K thereof are selectively brought into contact with the photosensitive member 22 or positioned at a specified developing position facing the photosensitive member 22 at a specified gap, the toner is imparted from a developing roller 44 provided in this developer and carrying the toner of the selected color to the outer surface of the photosensitive member 22. In this way, the electrostatic latent image on the photosensitive member 22 is developed in the selected toner color.

The toner image developed by the developing unit 4 as described above undergoes a primary transfer onto an intermediate transfer belt 71 of a transfer unit 7 in a primary transfer region TR1. The transfer unit 7 includes the intermediate transfer belt 71 mounted on a plurality of rollers 72 to 75 and a driving device (not shown) for driving the roller 73 to turn the intermediate transfer belt 71 in a specified turning direction D2. In the case of transferring a color image onto the sheet S, the toner images of the respective colors formed on the photosensitive member 22 are superimposed on the intermediate transfer belt 71 to form the color image, which then undergoes a second transfer onto the sheet S dispensed one by one from a cassette 8 and conveyed to a secondary transfer region TR2 along a conveyance path F.

At this time, a timing at which the sheet S is fed to the secondary transfer region TR2 is controlled in order to properly transfer the image on the intermediate transfer belt 71 to a specified position on the sheet S. Specifically, gate rollers 81 are provided before the second transfer region TR2 in the conveyance path F, and the sheet S is fed to the secondary transfer region TR2 at a specified timing by rotating the gate rollers 81 in conformity with a turning timing of the intermediate transfer belt 71.

The sheet S having the color image thus formed thereon is conveyed to be discharged onto a discharge tray 89 provided on the upper surface of the apparatus main body 1 via a fixing unit 9, pre-discharge rollers 82 and discharge rollers 83. Further, in the case of forming images on both surfaces of the sheet S, the rotating directions of the discharging rollers 83 are reversed when the trailing end of the sheet S having the image formed on one surface thereof as described above reaches a reversing position PR behind the pre-discharge rollers 82, whereby the sheet S is conveyed in a direction of arrow D3 along a reversing conveyance path FR. Then, the sheet S enters the conveyance path F again before the gate rollers 81. At this time, the surface of the sheet S to be brought into contact with the intermediate transfer belt 71 in the secondary transfer region TR2 to have an image transferred thereto is the surface opposite from the one where the image was already transferred. In this way, the images can be formed on both surfaces of the sheet S.

In addition, a density sensor 60 is disposed in the vicinity of the roller 75. The density sensor 60 confronts the surface of the intermediate transfer belt 71 and operates, as required, to take measurement of an image density of the toner image formed on the outside surface of the intermediate transfer belt 71. Based on the measurement results, the apparatus 1 adjusts the operating conditions of the individual parts of the apparatus which may affect image quality. The operating conditions include, for example, a developing bias applied to each of the developer, an intensity the exposure light beam L, tone correction characteristics of the apparatus and the like.

The density sensor 60 employs, for example, a reflective photosensor and is designed to output a signal corresponding to an image density of a region of a given area defined on the intermediate transfer belt 71. With the intermediate transfer belt 71 held in cycling motion, the CPU 101 periodically samples the output signal from the density sensor 60, thereby detecting an image density of an individual part of the toner image on the intermediate transfer belt 71.

As shown in FIG. 2, nonvolatile memories 91 through 94 are disposed onto the developers 4Y, 4C, 4M, 4K, respectively. These nonvolatile memories 91 through 94 are adapted to save information on the production lots, the used states, physical quantities representing the state and the like of the developer. Furthermore, the developers 4Y, 4C, 4M, 4K include connectors 49Y, 49C, 49M, 49K, respectively. When needed, the connectors 49Y, 49C, 49M, 49K are selectively brought into contact with a connector 109 of the apparatus main body. Accordingly, the CPU 101 and the memory 91 through 94 can exchange data via the interface 105, whereby the administration of the informations regarding the consumable supplies are carried out. In this embodiment, the developer side connector 49Y, 49C, 49M, 49K is mechanically connected with the main-body side connector 109 to carry out the reading and writing from and in the memory 91 through 94. However, the reading and writing may be carried out in a noncontacting manner using an electromagnetic means such as a radio communication using, for example, infrared rays.

In FIG. 2, a reference numeral 113 represents an image memory provided in the main controller 11 in order to store the image supplied from the external apparatus, such as a host computer, via an interface 112. A reference numeral 106 represents a ROM for storage of an operation program executed by the CPU 101 and control data used for controlling the engine section EG. A reference numeral 107 represents a RAM for temporary storage of operation results given by the CPU 101 and other data.

To save information related to the states of use of the respective portions of the apparatus, it is preferable to use non-volatile memories which save information even when not energized as these RAMs 107, 117 and 91 through 94. As such elements, flash memories, ferroelectric memories or the like may be used.

In addition, limit switches 122 and 132 for sensing whether a cover disposed to the housing of the apparatus is open or close are connected to a CPU 101 of this apparatus 1. These will be described in detail later.

Figure 3:
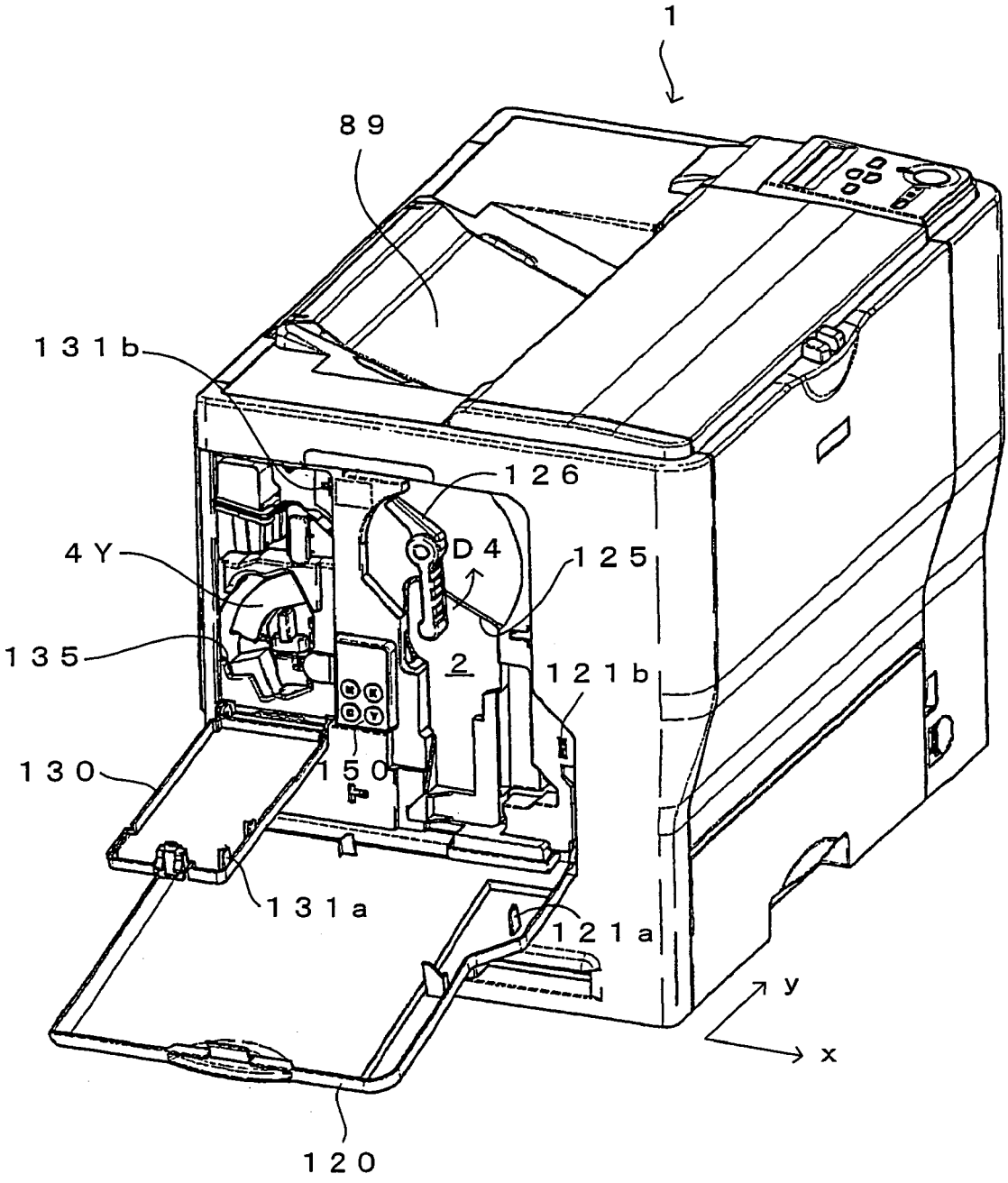
FIG. 3 is an external appearance view of the image forming apparatus of FIG. 1.

FIG. 3 is an external appearance view of the image forming apparatus shown in FIG. 1. As described earlier, developers 4Y, . . . are freely attachable to and detachable from a support frame 40 in the image forming apparatus 1. Further, a photosensitive cartridge 2 is freely attachable to and detachable from the main body of the apparatus. As shown in FIG. 3, an external cover 120 which can be opened and closed freely is attached to a side surface portion of the main body of the apparatus 1. When a user opens the external cover 120, a side surface portion of the photosensitive cartridge 2 is exposed through a photosensitive opening 125 which is formed in the main body of the apparatus. As a lock lever 126 for fixing the photosensitive cartridge 2 is revolved in the direction of the arrow D4, the lock is released, making it possible to pull out the photosensitive cartridge 2 along the direction of the axis (-y) in FIG. 3. Further, when a new photosensitive cartridge 2 is inserted along the direction of the axis y shown in FIG. 3 through the photosensitive opening 125, the new photosensitive cartridge 2 is attached. The photosensitive cartridge 2 is then fixed with the lock lever 125. As the photosensitive cartridge 2 is attached in this fashion, the side surface portion of the photosensitive cartridge 2 almost completely closes the photosensitive opening 125.

In addition, the main body of the apparatus has a developer opening 135 which is for attaching and detaching the photosensitive cartridge. An internal cover 130 which can be opened and closed freely is disposed as if to cover the developer opening 135. The internal cover 130 is disposed inside the external cover 120. In short, since the external cover 120 is disposed covering the developer opening 135, the internal cover 130 cannot be opened when the external cover 120 is closed. Conversely, unless the internal cover 130 is closed, the external cover 120 cannot be closed. When a user opens the internal cover 130, as long as a developer unit 4 is in a halt at a predetermined attaching/detaching position, it is possible to take out one of the attached developers through the developer opening 135. Further, at this stage, it is possible to attach one developer through the developer opening 135.

While a projection 121*a* is formed in the external cover 120, the main body has a hole 121*b* located at a position corresponding to the projection 121*a*. Further, the limit switch 122 which will be described later is attached to a bottom portion of the hole 121*b*. When the external cover 120 is closed, the projection 121*a* is inserted in the hole 121*b* which is formed in the main body, and the contact of the limit switch 122 disposed to the bottom portion of the hole 121*b* is closed.

The internal cover 130 comprises a similar mechanism to this. That is, while a projection 131*a* is disposed to the internal cover 130, the main body has a hole 131*b* located at a position corresponding to the projection 131*a*. As the internal cover 130 is closed, the projection 131*a* is inserted in the hole 131*b*, and the contact of a limit switch 132 (described later) disposed to a bottom portion of the hole 131*b* is closed.

There is another limit switch which is not shown in the drawings behind the photosensitive opening 125, and therefore, as the photosensitive cartridge is attached to the main body of the apparatus, the contact of this limit switch is closed. With respect to this limit switch, it is desirable that the contact of the limit switch is closed when the photosensitive cartridge 2 is attached perfectly correctly to the main body of the apparatus, but is not closed when the photosensitive cartridge is attached imperfectly. This is because it is necessary to detect that the photosensitive cartridge is attached securely, so that the developer unit 4 will not be rotated while the photosensitive cartridge is attached imperfectly and the apparatus will not get accordingly damaged.

In this image forming apparatus 1, as for each one of the external cover 120 and the internal cover 130, from the state of the contact of each corresponding limit switch, it is possible to learn whether each cover is open or close. In addition, it is possible to find whether the photosensitive cartridge 2 has been attached or not. This apparatus is structured so that the image forming operation is executed only when the external cover 120 and the internal cover 130 are closed and the photosensitive cartridge 2 is attached.

Figure 4:
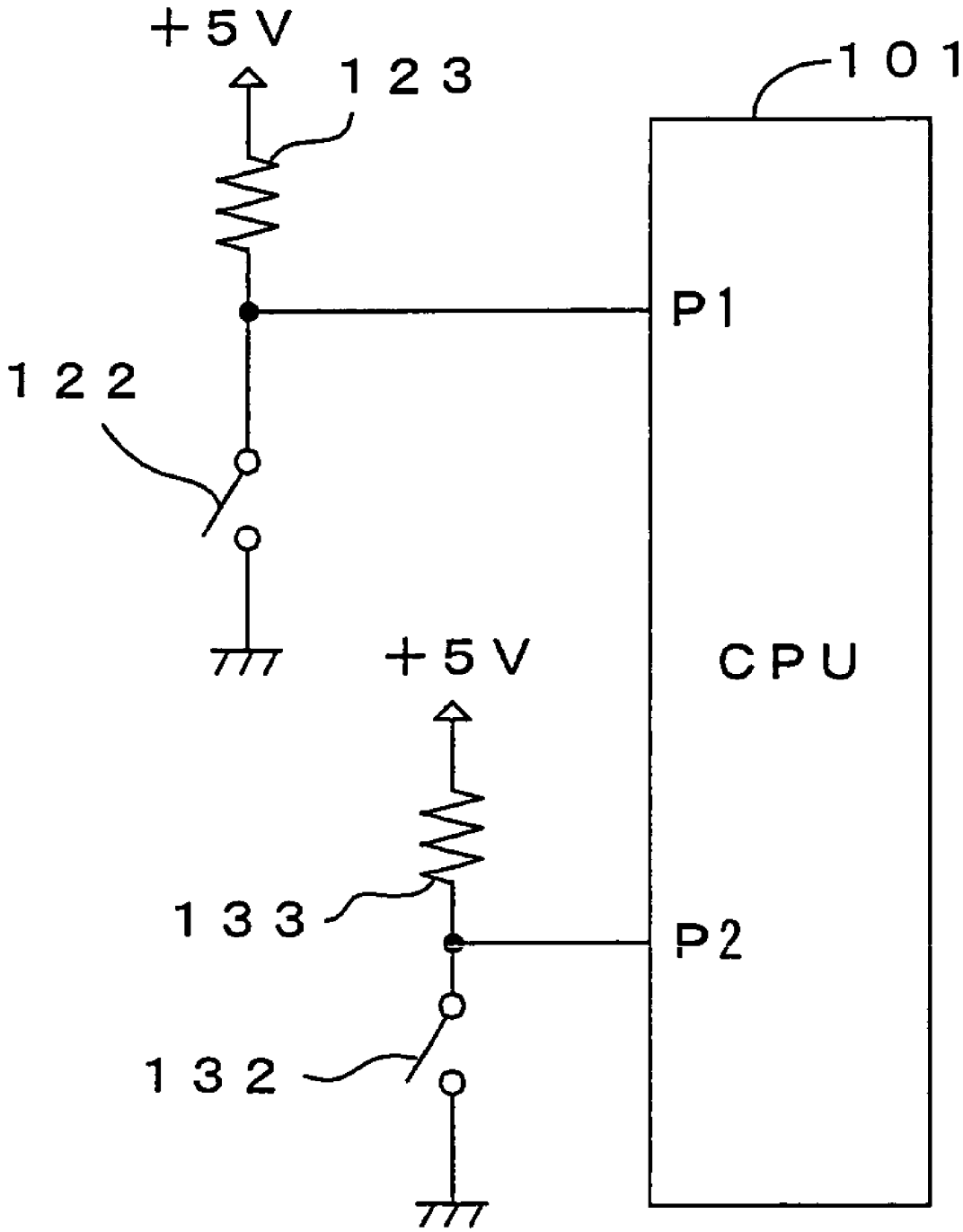
FIG. 4 is a drawing which shows connection between the limit switches and the CPU.

FIG. 4 is a drawing which shows connection between the limit switches and the CPU. As shown in FIG. 4, one ends of the limit switches 122 and 132 respectively for sensing whether the external cover 120 and the internal cover 130 are open or close are connected to a 5V-power source (not shown) which drives a control circuit respectively via pull-up resistors 123 and 133. The voltages at these ends are supplied respectively to input ports P1 and P2 of the CPU 101. The other end of each limit switch is grounded. Hence, the CPU 101 can grasp whether the external cover 120 and the internal cover 130 are each open or close, based on input voltages to the both ports P1 and P2.

To be more specific, when the external cover 120 is open, the input to the port P1 is the H level since the limit switch 122 is open. On the contrary, when the external cover 120 is close, the port P1 is grounded and at the L level since the limit switch 122 is close. This is the same as for the internal cover 130, the input to the port P2 becomes the H level or the L level in accordance with whether the internal cover 130 is open or close.

Figure 5:
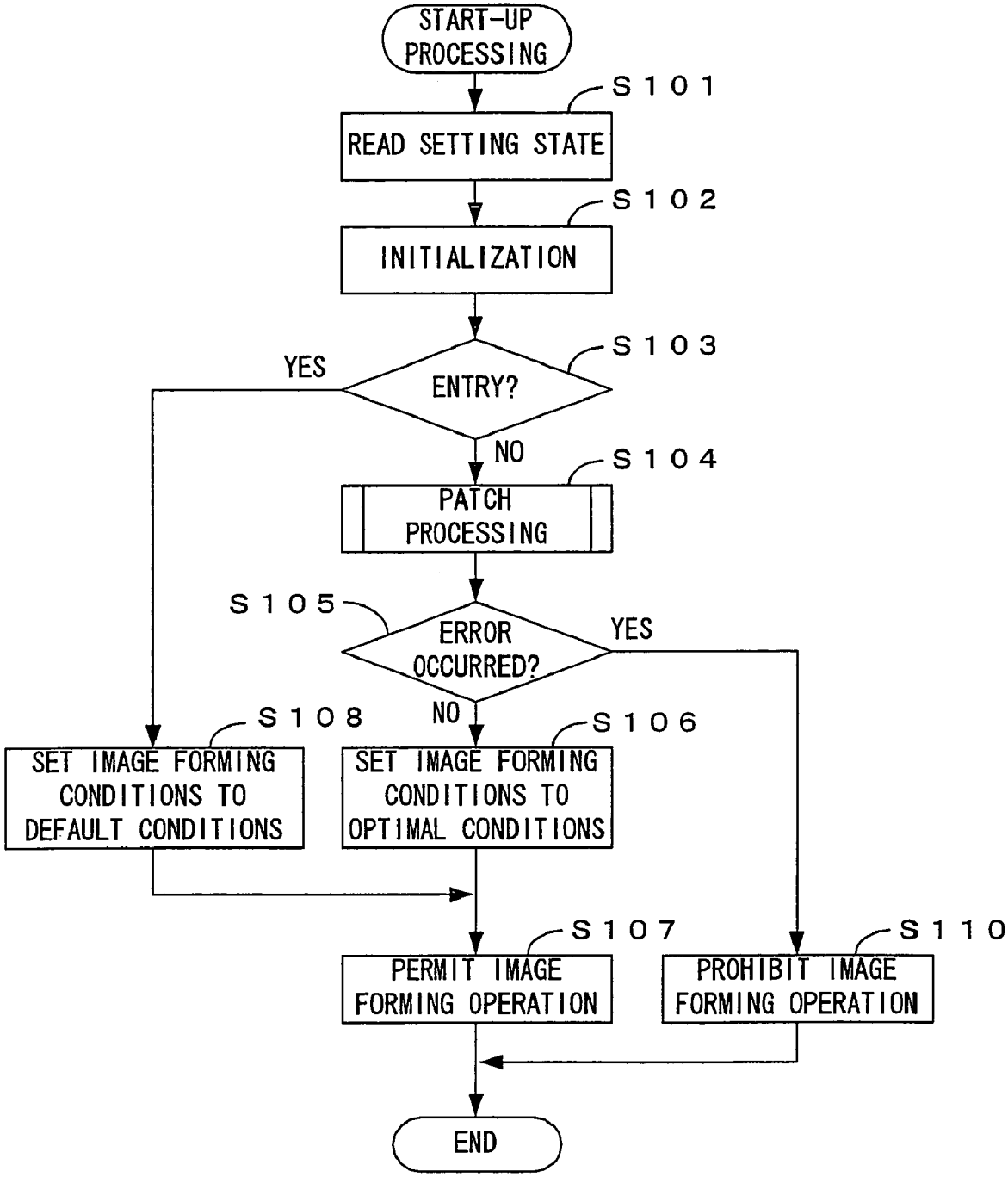
FIG. 5 is a flow chart of the start-up processing in this apparatus.

In this apparatus 1 having such a structure, as a user turns on the power of the apparatus, start-up processing shown in FIG. 5 is executed before forming an image. The start-up processing is executed in order to make the respective portions of the apparatus ready for the image forming operation through initialization and to set the image forming conditions of the apparatus to optimal conditions.

FIG. 5 is a flow chart of the start-up processing in this apparatus. During this start-up processing, as the power of the apparatus is switched on, the setting states of the respective portions of the apparatus at that time are read (Step S101). The "setting states" referred to in this context are the states of button switches and the like, which are disposed to the apparatus and can be operated by a user, at the time of power-on. In this embodiment, depending upon whether a certain switch is pressed at the time of power-on or not, the content of the start-up processing changes. The details of the content of the processing and the reason of this will be described in detail later.

Next, the respective portions of the apparatus are initialized (Step S102). The initialization includes: cleaning of surfaces of the photosensitive member 22, an intermediate transfer belt 71 and the like which is achieved by rotating the photosensitive member 22, an intermediate transfer belt 71 and the like; positioning of the developer unit 4 at a predetermined home position; increasing the temperature of a fixing unit 9 to a predetermined fixing temperature, etc. Since many techniques are already known as for such initialization, the initialization will not be described here.

Following this, whether a predetermined setting entry has been made in the setting state which was read at Step S101 is judged (Step S103). First, an occasion that the predetermined setting entry has not been made yet, that is, an occasion that the judgment at Step S103 is "NO" will be described. In this case, patch processing is executed after this (Step S103).

Figure 6:
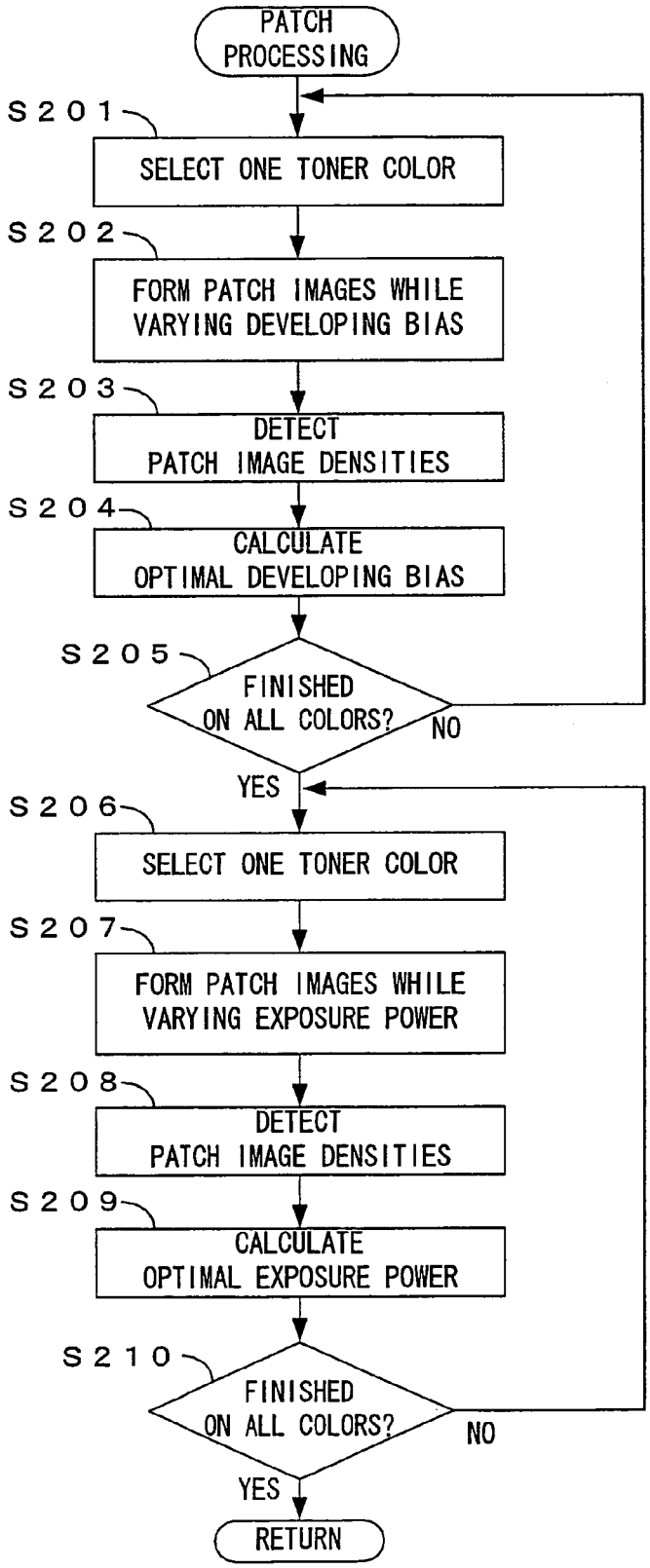
FIG. 6 is a flow chart of the patch processing performed by this apparatus.

FIG. 6 is a flow chart of the patch processing performed by this apparatus. The patch processing is processing of forming patch images and detecting the image densities of the patch images while varying the image forming conditions, and thereafter adjusting the image forming conditions based on the result of the detection, for the purpose of maintaining images in a constant image quality. During the patch processing, among operation parameters which determine operation conditions of the respective portions of the apparatus, a developing bias and an exposure power which serve as density control factors which influence the qualities of images are adjusted. Besides these, there are various parameters which are known as operation parameters which serve as density control factors, and many techniques are already known as for the principle of image quality control and a control method using these parameters. Hence, merely the flow of the processing will be described briefly.

First, for each toner color, an optimal developing bias, namely, an optimal value of the developing bias to be applied upon a developer roller 44 of each one of the developers 4Y, . . . during the image forming operation is calculated. To be more specific, one toner color is selected (Step S201), and on this toner color, while varying the developing bias over multiple levels, patch images having a predetermined pattern are formed at the respective bias values (Step S202). A density sensor 60 detects the image density of each patch image (Step S203). During this process, if an output from the density sensor 60 is an abnormal value, i.e., a value which is largely deviated from a value corresponding to a density which is predicted from the set value of the developing bias, the CPU 101 determines that abnormality has occurred in the apparatus, concludes that there is an error and sets an internal error flag which corresponds to this error. The CPU 101 stops the subsequent patch processing and returns back to the processing which is shown in FIG. 5.

Examples of the cause of such an error include those instances that the density of a patch image itself is abnormal owing for instance to failure of application of a normal developing bias upon the developer roller 44 or shortage of remaining toner, those instances that density detection cannot be performed properly because of abnormality in the density sensor 60 such as dirt, malfunction and the like of the density sensor 60, etc.

Once the image densities of the patch images are known, a relationship between the developing bias and the image densities can be identified from these values. The value of the developing bias which will match an image density to a predetermined target density is calculated from thus identified relationship. In this manner, the optimal developing bias is calculated (Step S205). However, in the event that this optimal value is not within a variable range of the developing bias set for this apparatus, the closest value to the calculated optimal value within the variable range is used as the optimal developing bias.

After calculating the optimal developing bias on one toner color in this fashion, the processing from S201 through S204 is repeated until the processing on all colors has finished (S205). In consequence, the optimal developing bias for each toner color is determined.

This is followed by calculation of an optimal exposure power for each toner color, namely, an optimal value of the intensity of an exposure beam L which is used to form an electrostatic latent image in this toner color on a photosensitive member 22 (Step S206 through Step S210). This processing is similar to the optimal developing bias calculating processing (Step S201 through Step S205) described above except for that the density control factor is the exposure power instead of the developing bias. In this case, the image pattern of patch images to be formed may be a different pattern from that used for the optimal developing bias calculating processing if necessary. The set value of the developing bias for this processing is preferably the optimal value described earlier. The optimal developing bias and the optimal exposure power are thus calculated on all toner colors, which terminates the patch processing.

Referring back to FIG. 5, upon completion of the patch processing (Step S104), whether an error has occurred during the patch processing is determined (Step S105). This judgment is made by checking the internal error flags handled by the CPU 101. When there is even only one flag set by the CPU 101 among those flags corresponding to the various errors, it is determined that "an error has occurred."

When there is no error and the optimal values of the respective density control factors have been all calculated, this set of thus calculated optimal values is stored as optimal image forming conditions for this apparatus at this time (Step S106).

The processing initializes the respective portions of the apparatus and makes them ready for execution of the image forming operation, and sets the image forming conditions to the optimal conditions. Execution of the image forming operation by an engine section EG is then permitted (Step S107) and the image forming operation is carried out under the optimal conditions, which makes it possible to form images stably in a desired image quality.

On the contrary, when it is judged at Step S105 that an error has occurred during the patch processing, the sequence proceeds to Step S110, prohibiting execution of the image forming operation by the engine section EG. In this manner, upon abnormality in the apparatus, outputting of an image having an inferior image quality is prevented.

On the occasion of prohibition of the image forming operation because of an error, a user or operator turns on the power and starts up the apparatus after eliminating the cause of the error, whereby the image forming conditions are adjusted to optimal conditions and the apparatus becomes ready for execution of the image forming operation.

However, this countermeasure will not always benefit a user. An example is an error owing to toner shortage within the developer and a consequent insufficient density of a patch image. In this case, although this error will be eliminated if a user exchanges this developer with a new developer, the user may wish to form an image continuously using the old developer, e.g., when the user has not procured a new developer yet. On such an occasion, the user's intention is to continue forming an image despite the recognized inadequacy of density. Prohibition of the operation on the ground that the density is not sufficient is therefore not user friendly.

Another example is an intention to use the apparatus merely for the purpose of printing an image formed by letters and characters in a moderate image quality. In this case, the waiting time and an increased consumption of toner because of the patch processing gives nothing to gain to a user who is not asking particularly for a high image quality but rather can go against the user's benefit. The situation like this is to be addressed these days in particular, because as apparatuses become more advanced, while a moderate image quality is attained even when the patch processing is not executed frequently, there is an increasing demand for a faster operation speed and more efficient use of toner. To meet this demand, it is necessary to permit the image forming operation while skipping the patch processing regardless of whether there is a cause of an error.

Noting this, in the case of this apparatus, when a user operates the apparatus in a predetermined special operation, the start-up processing is executed without performing the patch processing to thereby allow execution of the image forming operation. While the image forming operation permitted in this way does not necessarily ensure the best image quality, since this operation is in response to a user's wish, a deterioration of the image quality to a certain extent should be acceptable.

The "special operation" referred to above means for example that an operator opens both the external cover 120 and the internal cover 130 (FIG. 3) and turns on the power while pressing, with the tip of a pen or the like, the limit switch 122 which is disposed at the bottom of the hole 121*b* formed in the side surface of the apparatus. In this condition, the limit switch 132 corresponding to the internal cover 130 is open and the limit switch 122 corresponding to the external cover 120 is close. Since the internal cover 130 is hidden behind the external cover 120 in this apparatus 1, unless the external cover 120 is opened, the internal cover 130 cannot be opened. Hence, the condition above is a special condition which is impossible during normal use. In other words, this special condition created by the user serves as representation of the user's will that the user does not want the patch processing.

Whether the power of the apparatus has been turned on under the special condition or under a normal condition is judged by reading the states of these limit switches at the time of power-on, that is, the states of the ports P1 and P2 of the CPU 101. In short, "READ SETTING STATE" at Step S101 in FIG. 5 is a processing step for judging this. To be more specific, immediately after power-on, the CPU 101 reads the "setting state" of the apparatus, namely, the states of the ports P1 and P2 and when these are at the L level and the H level respectively (which is the "special condition" described above), the CPU 101 sets an internal flag which is indicative of this. On the contrary, when the ports are found to be in a different combination, since that is normal power-on, this internal flag is reset. At Step S103, this internal flag is checked and it is judged that a setting entry has been made when this internal flag is set but that a setting entry has not been made when this internal flag is reset. Since it is judged that a setting entry has not been made after normal power-on, the start-up processing described earlier is executed.

In contrast, when it is judged that a setting entry has been made, a different operation from the above will be performed. That is, the image forming conditions are set to predetermined default conditions without executing the patch processing (Step S108), and execution of the image forming operation is permitted (Step S107). In this manner, the engine section EG is made ready for the image forming operation with the image forming conditions set to predetermined default conditions, regardless of whether there is a cause of an error and whether the conditions are optimal considering the current state of the apparatus.

Since the image forming operation executed in such a condition skips the patch processing, a predetermined image quality may not be necessarily obtained. Therefore, to notify an operator of the status of the apparatus at that point, a status sheet describing information regarding the status of the apparatus may be outputted. For instance, as the start-up processing shown in FIG. 5 is modified as described below, a status sheet is outputted.

Figure 7:
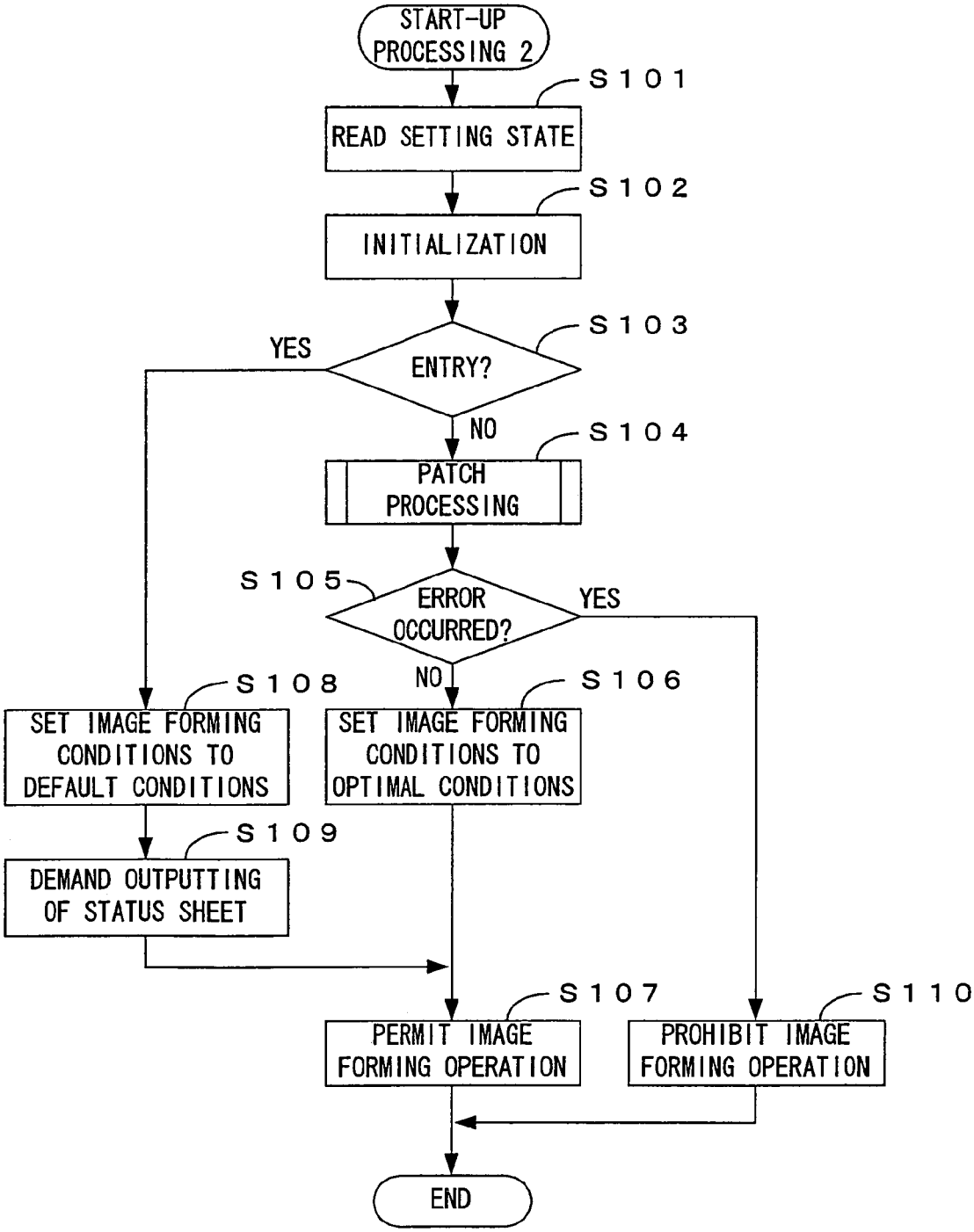
FIG. 7 is a flow chart of the start-up processing performed in this apparatus according to a different aspect.

FIG. 7 is a flow chart of the start-up processing performed in this apparatus according to a different aspect. During this second start-up processing, when a setting entry for prohibiting the patch processing is made at the time of power-on, after setting the image forming conditions to predetermined default conditions (Step S108), the engine section EG is demanded outputting of a predetermined status sheet. The content of this start-up processing is otherwise the same as the start-up processing shown in FIG. 5. In this manner, when a user turns on the power while pressing the limit switch 122, the apparatus starts up without execution of the patch processing and a status sheet describing predetermined information is outputted on a sheet S. From the status sheet outputted on the sheet S, the operator learns about the current state of the apparatus, and upon occurrence of an error, utilizes this to identify the cause of the error.

While it is preferable that the status sheet describes the following items for instance, the status sheet may describe some of these items or other items than these: the use time of use of the photosensitive member 22, the developers 4Y, . . . , etc; the remaining toner amount in each developer; the set values of the optimal developing bias and the optimal exposure power for each toner color; the states of the internal flags; and the version of control software in the CPUs 101 and 111.

Of these, the time of use of the photosensitive member 22 and the respective developers tells the condition of wearing of each portion of the apparatus. Meanwhile, the remaining toner amount in each developer tells whether there is a possibility that the timing of exchanging the developer and the remaining toner amount will cause an error. The set values of the optimal developing bias and the optimal exposure power for each toner color tell how each parameter is set, i.e., in which condition the apparatus is used. The set values to be displayed are not limited to the current set values but may be those values which used to be set immediately before occurrence of an error. From the states of the internal error flags, it is possible to know when the error occurred. From the version of control software, it is possible to know the content of control processing which is being executed in this apparatus. Each one of these informations is information which helps specify the cause of the error.

Instead of a status sheet listing up the status of the apparatus or in addition to these items, a test image such as a test pattern which easily tends to reflect the status of the apparatus may be outputted.

The quality of an image which is formed while skipping the patch processing may be just to the extent that the information above can be easily read. The default conditions as the image forming conditions in this instance may merely be such conditions which make it possible to form an image of characters in a certain quality. For instance, the image forming conditions identified by determining the respective operation parameters by any one of the methods (1) through (4) below may be used as default conditions.

(1) All operation parameters are set to predetermined standard values. In other words, standard image forming conditions from which a quality to a certain extent can be expected are determined in advance in accordance with the structure, the characteristics and the like of the apparatus, and these conditions are set as the default conditions.

(2) All operation parameters are set to immediately previous optimal values. While the operating status of the apparatus changes with time, it is rare that the status changes greatly in a short period of time. Therefore, the image forming conditions which used to be set before execution of the patch processing and have resulted in an error, i.e., the optimal conditions appropriately calculated during the previous patch processing are used as default conditions, to thereby obtain an image quality which is relatively close to that attained at the time of execution of the previous patch processing.

(3) Parameters as for which optimal values were calculated before an error are set to these optimal values, while parameters as for which optimal values could not be calculated because of the error are set to standard values which have been determined in advance. When an error occurs during the patch processing, it is possible that optimal values of some operation parameters have been already calculated. Therefore, these operation parameters are set to newly calculated optimal values, and the operation parameters for which calculation of optimal values failed as the occurrence of the error interrupted the patch processing are set to standard values which have been determined in advance. This makes it possible to form an image under image forming conditions which are close to the optimal conditions at that time.

In this embodiment, an optimal developing bias is calculated for each toner color first, and an optimal exposure power for each toner color is then calculated. Because of this, with respect to any error, as long as only one of the toner colors is concerned, depending upon when the error occurred, an optimal developing bias and an optimal exposure power may have been both already calculated or neither has been already calculated. In the former instance, newly calculated optimal values may be used as the both parameters, while in the latter instance, the standard values which have been determined in advance may be used as the both parameters. Still other possibility is that although an optimal developing bias has been calculated, an optimal exposure power has not been calculated yet. In such a case, the standard values may be used as the both parameters on the ground that optimal value calculation has not completed on this color. Alternatively, as for the developing bias for which calculation of an optimal value has finished, the optimal value may be used as the developing bias, and as for the exposure power for which calculation of an optimal value has not completed, the standard value may be used as the exposure power.

(4) A parameter as for which an optimal value was calculated before an error is set to this optimal value, while a parameter as for which an optimal value could not be calculated because of the error is set to an immediately previous optimal value. This is a partially modified version of (3) described above. In other words, as for the parameter for which calculation of an optimal value failed as the occurrence of the error interrupted the patch processing, the optimal value calculated during the previous patch processing is used instead of the standard value which has been determined in advance, whereby a similar effect promised by the method (3) is obtained.

These default conditions are not limitedly applied to an instance that outputting of a status sheet like the one described above is wanted but may be applied to where an image is to be formed based on a user's request. In addition, either (1) or (2) may be used as default conditions for other processing than that which accompanied an error during the previous start-up processing.

As described above, in this embodiment, after the power of the apparatus is turned on, patch images are formed and the patch processing for adjusting the image forming conditions based on the detected densities of the patch images is executed. The image forming operation is executed under the image forming conditions thus adjusted to optimal conditions, and therefore, it is possible to form an image in a predetermined image quality in a stable manner immediately after power-on. Meanwhile, when optimal image forming conditions were not calculated owing to abnormality or the like within the apparatus, execution of the image forming operation is prohibited. This prevents formation of an image having a poor image quality under inappropriate image forming conditions, and hence, wasteful use of toner, sheets S, etc.

However, when the power of the apparatus has been turned on with a special operation, that is, with a particular switch pressed so as to skip the patch processing in accordance with a user's wish, the apparatus becomes ready for the image forming operation while skipping the patch processing.

Further, when a status sheet is outputted, an operator of the apparatus can grasp the status of the apparatus from the outputted status sheet and can easily specify the cause of an error or take countermeasures against the error. The image forming apparatus according to this embodiment is thus capable of flexibly meeting a user's demand to form an image while skipping the patch processing, and is convenient to an operator even upon occurrence of an error.

In addition, an operator can select whether to execute the patch processing after power-on, which is convenient also for an operator or a service person to check the operations of the apparatus or perform maintenance/inspection work.

As described above, in this embodiment, the engine section EG which executes the image forming operation functions as the "image forming section" of the present invention, while the CPU 101 which controls the operation of this functions as the "controller" of the present invention. The patch processing which is executed to adjust the image forming conditions corresponds to the "control processing" of the present invention, and the limit switch 122 which is for setting such that this processing will not be executed after power-on corresponds to the "setting section" of the present invention.

The present invention is not limited to the preferred embodiment above, but may be modified in various manners in addition to the preferred embodiment above, to the extent not deviating from the spirit of the invention. For instance, although the embodiment described above requires that when calculation of optimal values of the operation parameters has failed as a result of the patch processing, this is determined an error and the subsequent image forming operation is prohibited. However, since the spirit of the invention lies in permission of the image forming operation without the patch processing in response to an operator's wish regardless of whether to prohibit the image forming operation, the processing of prohibiting the image forming operation is not indispensable.

Further, although the modification of the preferred embodiment above demands that a status sheet is outputted upon execution of the start-up processing without the patch processing, this is not limiting. A status sheet may be outputted in response to a particular operation provided by a user after the start-up processing for instance. Alternatively, only when an error has occurred during the previous start-up processing, a status sheet may be outputted during the following start-up processing.

Further, although the preferred embodiment above demands that when the start-up processing is executed without the patch processing, the image forming operation is executed with the image forming conditions for the respective colors set to the default conditions. However, since an image formed by letters and characters and particularly a status sheet may merely be a monochrome image in general, in such a case, formation of a monochrome image (which is in the black color practically) alone may be permitted and the image forming operation in the other toner colors may be stopped for example.

Further, in the preferred embodiment above, the start-up processing not accompanying the patch processing is executed in response to a special user operation of turning on the power while pressing the limit switch 122 which is for sensing whether the external cover 120 is open or close. However, this is not limiting. This operation may be performed in other manner. Still, since this operation should not be performed daily, it is preferable that an extraordinary operation which will not be performed usually triggers this operation. In addition, it is not always necessary for this operation to include turning on of the power again or initialization of the apparatus. For instance, when a plurality of buttons are pressed in combination at the same time or pressed in some particular order, in response to this, the apparatus may be made ready for the image forming operation without re-execution of the patch processing.

Further, although the preferred embodiment above demands execution of the patch processing in accordance with the operation of turning on the power, this is not limiting. The patch processing may be executed in accordance with other operation which may be a predetermined key operation by a user during energization for example.

The structure according to the preferred embodiment above is not limiting. For instance, the present invention is applicable also to an apparatus which comprises a developer for black toner and forms a monochrome image, an apparatus which comprises other transfer medium (a transfer drum, a transfer sheet, etc.) than an intermediate transfer belt, and other image forming apparatus such as a copier machine and a facsimile machine.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. An image forming apparatus, comprising:

an internal cover which is disposed to cover an opening which is provided in a main body;

an external cover which covers a surface of the main body as well as the internal cover;

an image forming section which executes an image forming operation;

a setting section which is operated by a user and a setting state of which is set to a special condition in accordance with a special operation, wherein the setting section includes a plurality of switches which are respectively turned on and off by the user, the plurality of switches including a first switch which is turned on when the internal cover is closed and a second switch which is turned on when the external cover is closed;

a judging controller which judges whether the setting state of the setting section is the special condition or not in response to a power-on operation performed by the user, wherein the judges controller detects on/off states of the plurality of the switches and judges that the setting state of the setting section is the special condition when the first switch is turned off and the second switch is turned on;

a processing controller which executes control processing when the judging controller judges that the setting state of the setting section is not the special condition, the control processing adjusting image forming conditions, which are to be used for execution of the image forming operation, to predetermined optimal conditions based on detected densities of patch images formed by the image forming section; and a prohibiting controller which prohibits the image forming section from executing the image forming operation when the processing controller has failed to adjust the image forming conditions to the optimal conditions in the control processing, wherein the processing controller permits the image forming section to execute the image forming operation without executing the control processing when the judging controller judges that the setting state of the setting section is the special condition.

2. The image forming apparatus of claim 1, wherein the controller adjusts the image forming conditions to the default conditions which are standard conditions which have been determined in advance.

3. The image forming apparatus of claim 1, wherein the controller adjusts the image forming conditions to the default conditions which are the optimal conditions which were used during the control processing which was executed immediately previously.

4. A control method for an image forming apparatus which comprises an internal cover which is disposed to cover an opening which is provided in a main body, an external cover which covers a surface of the main body as well as the internal cover, an image forming section which executes an image forming operation and a setting section which is operated by a user, wherein the setting section includes a plurality of switches which are respectively turned on and off by the user, the plurality of switches including a first switch which is turned on when the internal cover is closed and a second switch which is turned on when the external cover is closed, the method comprising the steps of:

detecting on/off states of the plurality of the switches;

judging whether the setting state of the setting section is the special condition or not in response to a power-on operation performed by the user, wherein the setting state is judged to be the special condition when the first switch is turned off and the second switch is turned on;

executing control processing when it is judged that the setting state of the setting section is not the special condition, the control processing adjusting image forming conditions, which are to be used for execution of the image forming operation, to predetermined optimal conditions based on detected densities of patch images formed by the image forming section;

prohibiting the image forming section from executing the image forming operation when adjusting the image forming conditions to the optimal conditions has failed in the control processing; and permitting the image forming section to execute the image forming operation without executing the control processing when it is judged that the setting state of the setting section is the special condition.

* * * * *